US005651525A

United States Patent [19]

Yang

[11] Patent Number: 5,651,525

[45] Date of Patent: Jul. 29, 1997

[54] READING STAND

[76] Inventor: Sikyung Yang, 2837-1, Sakye-ri, Anduk-myun, Namjeju-kun, Jeju-do, Rep. of Korea

[21] Appl. No.: 495,263

[22] Filed: Jun. 27, 1995

[30] Foreign Application Priority Data

Jun. 28, 1994 [KR] Rep. of Korea ..... 94-15546

[51] Int. Cl.[6] ..... A47G 1/24

[52] U.S. Cl. ..... 248/456; 248/444.1; 248/447; 248/449; 248/453

[58] Field of Search ..... 248/456, 441.1, 248/444, 444.1, 446, 447, 451, 453, 454, 455, 457, 460, 462, 354.6, 452, 465, 449

[56] References Cited

U.S. PATENT DOCUMENTS

| | | | |
|---|---|---|---|
| 2,091,260 | 8/1937 | Farkas et al. | 40/726 |
| 2,863,256 | 12/1958 | Hegarty | 248/444 |
| 4,164,085 | 8/1979 | Steeb et al. | 40/781 |
| 4,181,282 | 1/1980 | Oliver et al. | 248/451 |
| 4,323,214 | 4/1982 | De Luca | 248/456 |
| 4,618,119 | 10/1986 | Powell | 248/456 |
| 5,035,393 | 7/1991 | Menaged | 248/456 |

FOREIGN PATENT DOCUMENTS

| | | |
|---|---|---|
| 891167 | 3/1989 | Rep. of Korea . |
| 892053 | 3/1989 | Rep. of Korea . |

*Primary Examiner*—Leslie A. Braun
*Assistant Examiner*—Anita M. King
*Attorney, Agent, or Firm*—Christie, Parker & Hale, LLP

[57] ABSTRACT

The invention provides a reading stand including: a base member for the foundation; a plate connected to the base member rotatably for supporting reading material; a transparent plate connected with the plate on the upper edge of the plate, which can be arranged to be in the same plane with the plate and folded toward the plate; a supporting member which supports the lower edge of the reading material placed on the upper surface of the plate; a height adjustment device which adjusts a height of the supporting member, thereby adjusting the height of the reading material; and an angle adjusting device for adjusting the inclination angle of the plate.

5 Claims, 8 Drawing Sheets

READING STAND

BACKGROUND OF THE INVENTION

1. Field of the Invention

The invention relates to a reading stand and, more particularly, to a reading stand that can be folded for easy carrying and storage and the height and angle can be adjusted so that a reader can read either lying down or sitting up.

2. Description of the Prior Art

A reading stand by which a reader can read while lying down is already known and is available from the Korean utility model Publication No. 89-1167 and the Korean utility model laid-open Publication No. 89-2053.

The above reading stands form a pillow by a base plate and can adjust the angle and the height of the reading material.

Also, the reading stands are provided with an illuminating means so that in the night the reader can read while resting his or her head on the pillow.

Korean utility model Publication No. 93-8057 provides another reading stand, which can be angled so that the reader can read two texts simultaneously for comparison and can read while lying down.

But the above-described reading stands are complex in their construction and, in the first and second above-described reading stands, reader reads only in a lying position.

SUMMARY OF THE INVENTION

The present invention has been made in an effort to solve the above problems.

It is an object of the invention to provide a reading stand which can adjust the height and angle of the reading material, is compact in size and is convenient for carrying and storage.

It is another object of the invention to provide a reading stand by which a reader can read conveniently while lying down as well as in sitting up.

To achieve the above objects, the invention provides a reading stand including: a base member for the foundation; a plate formed of transparent material connected to the base member rotatably for supporting reading material; a supporting member which supports the lower edge of the reading material placed on the upper surface of the plate; and an angle adjusting device for adjusting the inclination angle of the plate.

The present invention also provides a reading stand including: a base member for the foundation; a plate connected to the base member rotatably for supporting reading material; a transparent plate connected with the plate on the upper edge of the plate, which can be arranged to be in the same plane with the plate and folded toward the plate; a supporting member which supports the lower edge of the reading material placed on the upper surface of the plate; a height adjustment device which adjust the height of the supporting member, thereby adjusting the height of the reading material; and an angle adjusting device for adjusting the inclination angle of the plate.

DETAILED DESCRIPTION OF THE PREFERRED EMBODIMENT

The preferred embodiment of the invention will now be described with reference to the drawings.

Figure 1:
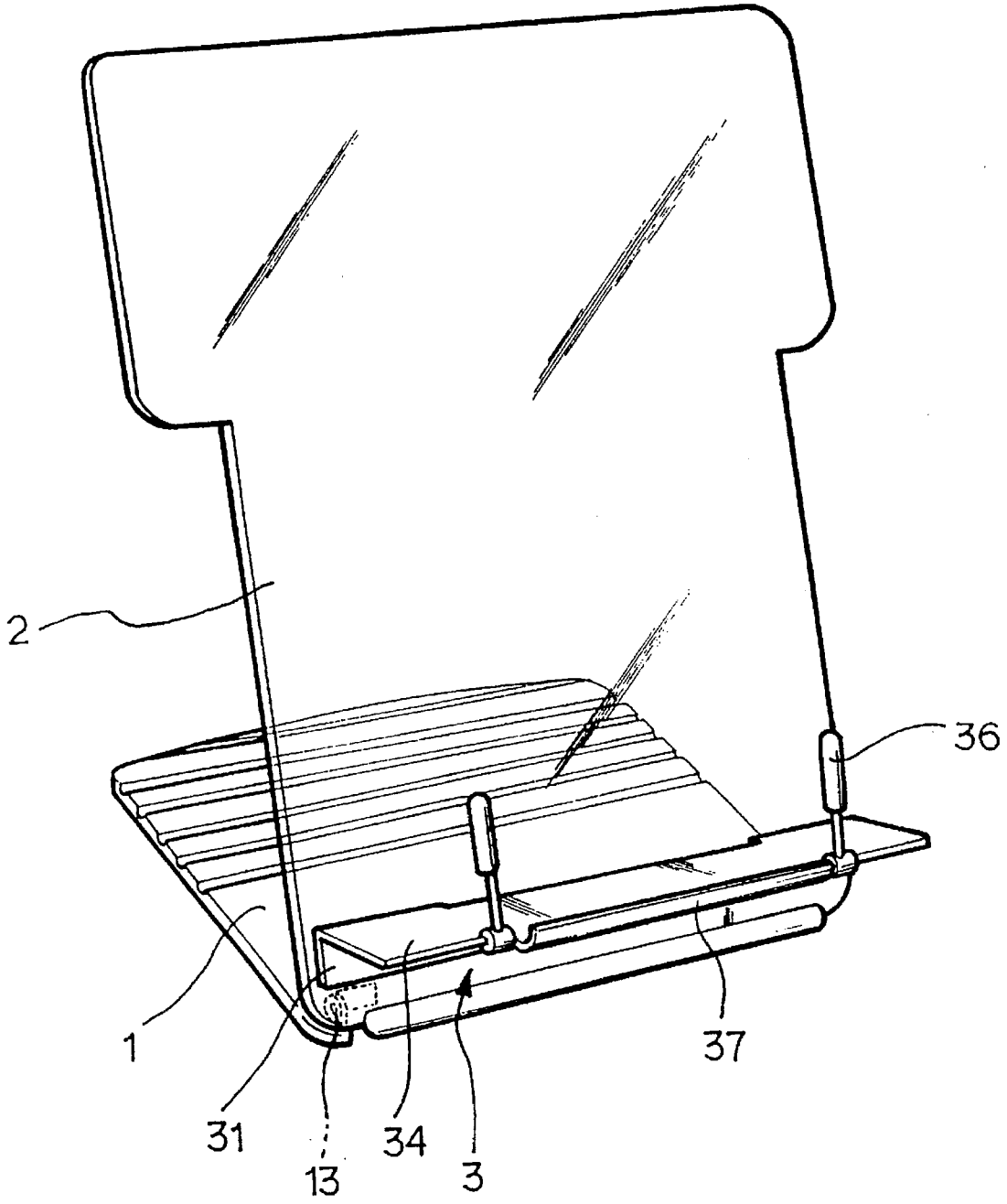
FIG. 1 is a perspective view of the reading stand related to the first embodiment of the invention.
Figure 2:
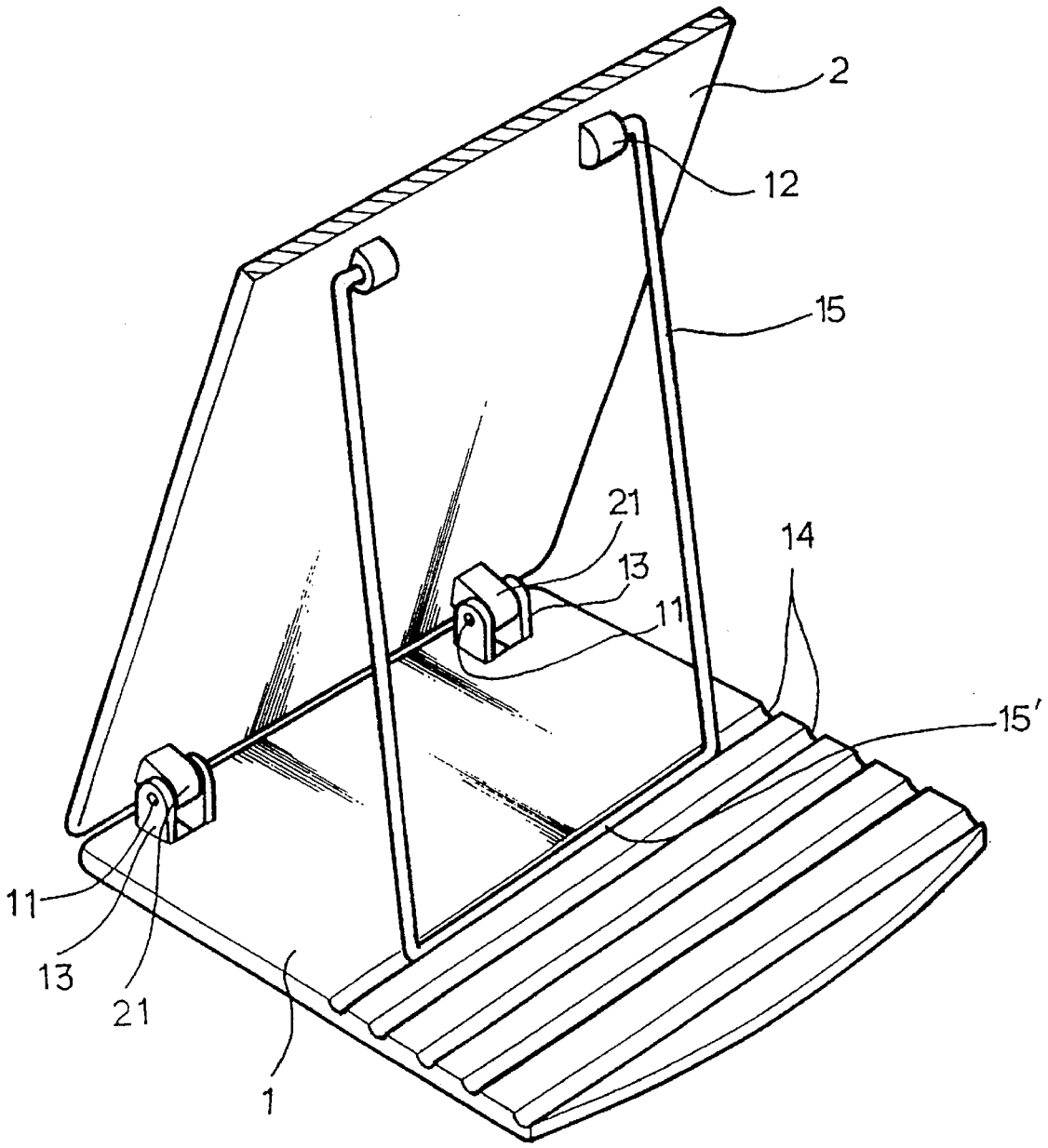
FIG. 2 is a perspective view showing an angle adjustment device related to the first embodiment of the invention.
Figure 3:
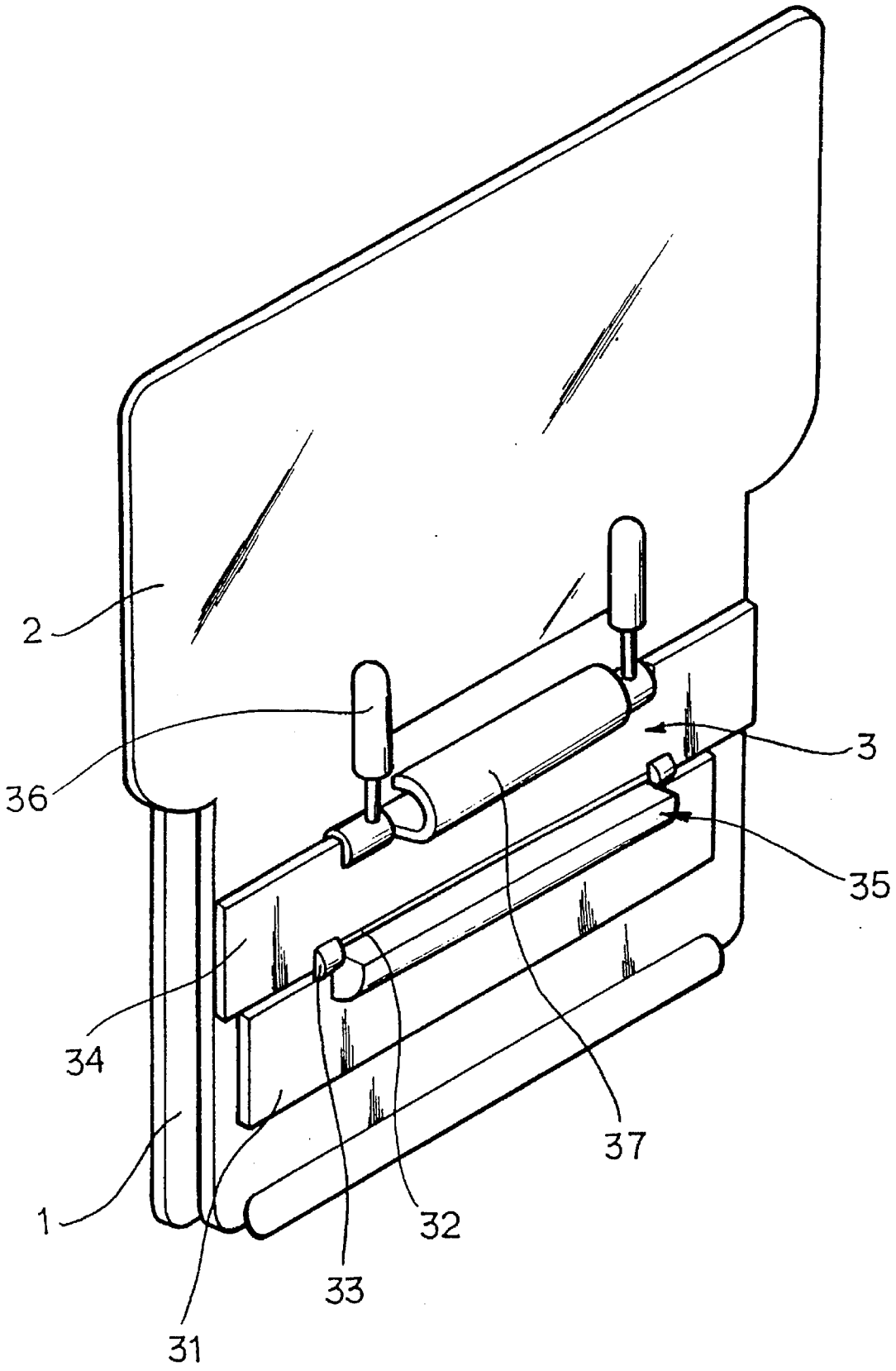
FIG. 3 is a view showing the folded state of the reading stand related to the first embodiment of the invention.
Figure 4:
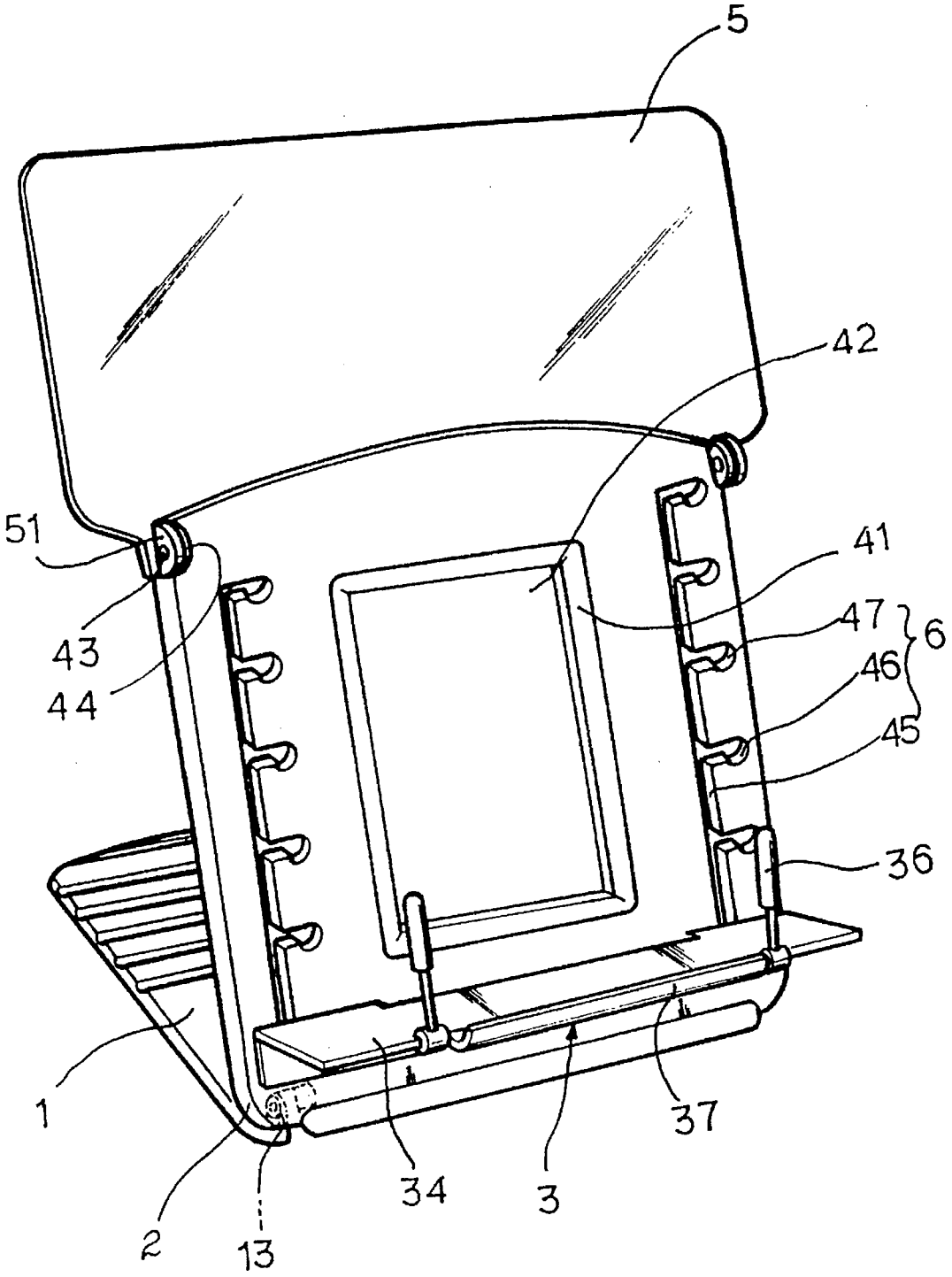
FIG. 4 is a perspective view of the reading stand related to the second embodiment of the invention.
Figure 5:
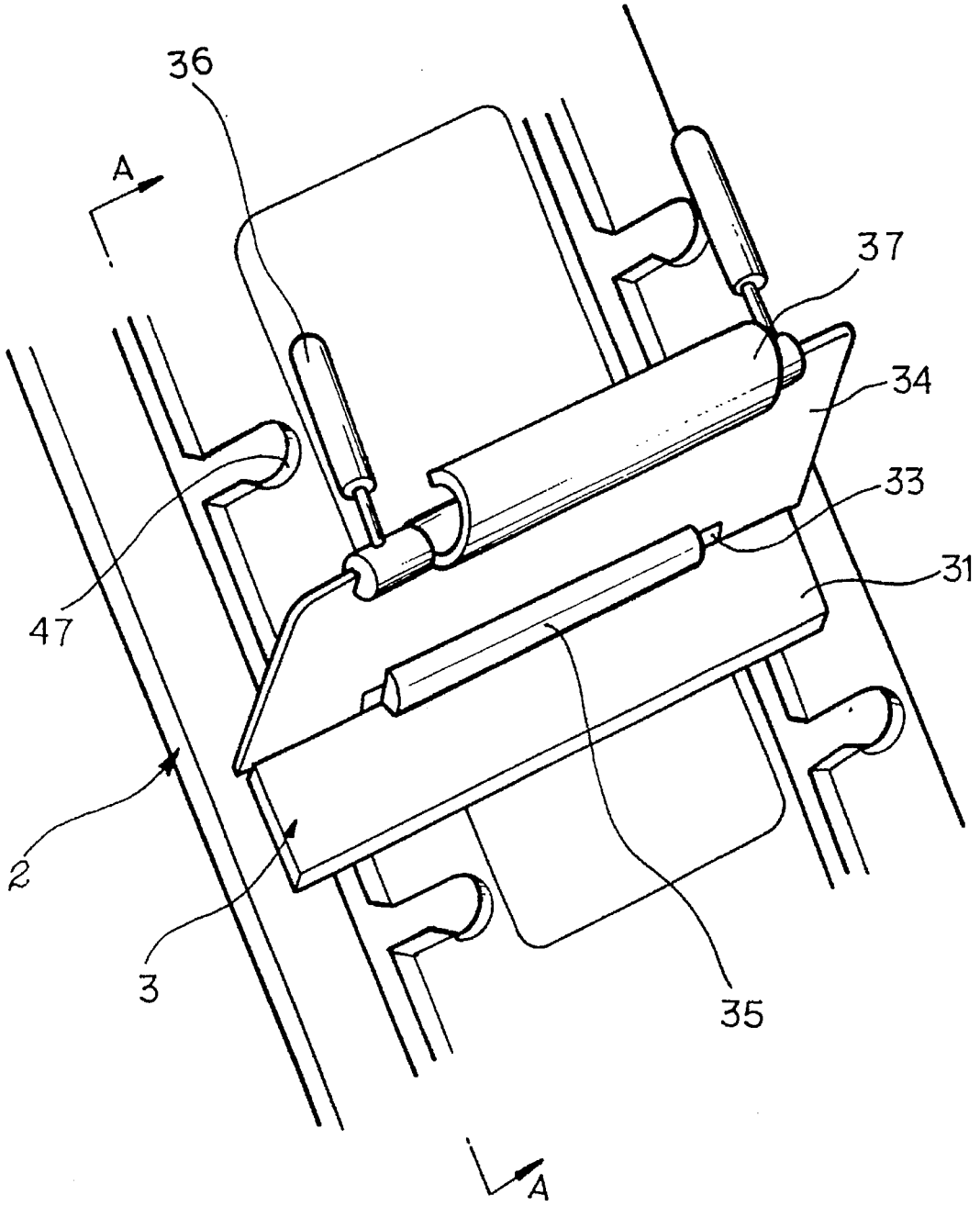
FIG. 5 is a perspective view for a height adjustment device related to the second embodiment of the invention.

FIGS. 1 to 3 show a reading stand related to the first embodiment of the invention.

The reading stand has a base member 1 for a foundation and a first hinge part 13 in which hinge pin 11 protrudes upwardly on one side edge of the base member 1.

A second hinge part 21 is integrally formed with a plate 2 for supporting reading material and the second hinge part 21 is connected to the first hinge part 13.

Hence, plate 2 is connected to one side edge of the base member 1 rotatably.

Plate 2 is formed of a transparent material which makes it possible to see the reading material through the plate 2 at either the front or rear of the plate.

A supporting member 3, which supports the lower edge of the reading material is provided in the lower position of the upper surface of the plate 2.

The supporting member 3 includes a propping plate 31 secured to the plate 2 and a supporting plate 34.

The supporting plate 34 has a third hinge part 33 including slots and the propping plate 31 has a fourth hinge part 32.

Both hinge parts are combined by inserting a protrusion formed in the fourth hinge part of the propping plate, not shown, into the slot of the third hinge part 33 in the supporting plate.

Then the supporting plate 34 is connected to the propping plate 31 rotatably.

Stopper 35 limits the revolution angle of the supporting plate 34, i.e, because of the stopper, 35 the supporting plate cannot rotate over 90 degrees from the horizontal angle with respect to the propping plate 31.

A fixing element 36 arranged rotatably on the leading edge of the supporting plate 34 is provided for pushing reading material on the supporting plate toward the plate 2.

A curved-shaped part 37 extends from the leading edge of the supporting plate 34 which provides a place for a writing means such as a pen.

The reading stand includes an angle adjustment device for adjusting the angle of reading material.

The angle adjustment device includes a support 15 connected rotatably to a fifth hinge part 12 provided in the rear surface of the plate 2 and multiple recesses 14 formed on the base member 1, as shown in FIG. 2.

The free end 15' of the support 15 can be fit into the recesses 14 stepwise so that the angle of the plate 2 is adjusted, thereby adjusting the angle of the reading material.

FIG. 3 is a view showing the folded state of the reading stand and, as shown in the Figure, the reading stand is convenient for carrying and storage.

FIGS. 4 to 7 show a reading stand related to the second embodiment of the invention.

In these figures, the same number signs are used for the same parts which the first embodiment also has according to the invention.

The reading stand related to the second embodiment includes a base member 1 for the foundation and a plate 2 for supporting the reading material.

The plate 2 is connected to the base member 1 rotatably and the connection is accomplished by connecting a first hinge part 13 to a second hinge part 21 the same way as in the first embodiment of the invention.

The plate 2 may be formed of nontransparent material, and there is a rectangular-shaped concave part 42 in the front surface of the plate 2 and a frame 41 fit into the rectangular-shaped concave part 42.

A photo or picture, etc., can be set in the rectangular-shaped concave part 42 and the frame 41 holds the photo or picture.

A transparent plate 2 is connected to the plate 4 on the upper edge of the plate 2.

The transparent plate 5 is piled on the plate 4 and both plates are combined by inserting a protrusion 43 formed in a sixth hinge part 44 disposed at the upper end of both sides of the plate 2 into a hole of a seventh hinge part 51 disposed at the lower part of the transparent plate 5.

Accordingly, the transparent plate 5 can be arranged to be in the same plane with the plate 2 to read through the rear surface of the transparent plate 5 and can be also folded toward the plate 2.

The reading stand related to the second embodiment of the invention is provided with a supporting member 3 including a supporting plate 34, propping plate 31, and a fixing element 36 similar to as the reading stand related to the first embodiment of the invention.

The present embodiment includes a height adjustment device 6 for adjusting the height of reading material.

The height adjustment device 6 includes two guide slots 45, each of which is formed on the plate 2 longitudinally corresponding to the propping plate 31 and a plurality of notches 46 formed in the guide slots and perpendicular to the guide slots 45.

The direction of the notches formed in two guide slots is the same and can be left or right.

Figure 6:
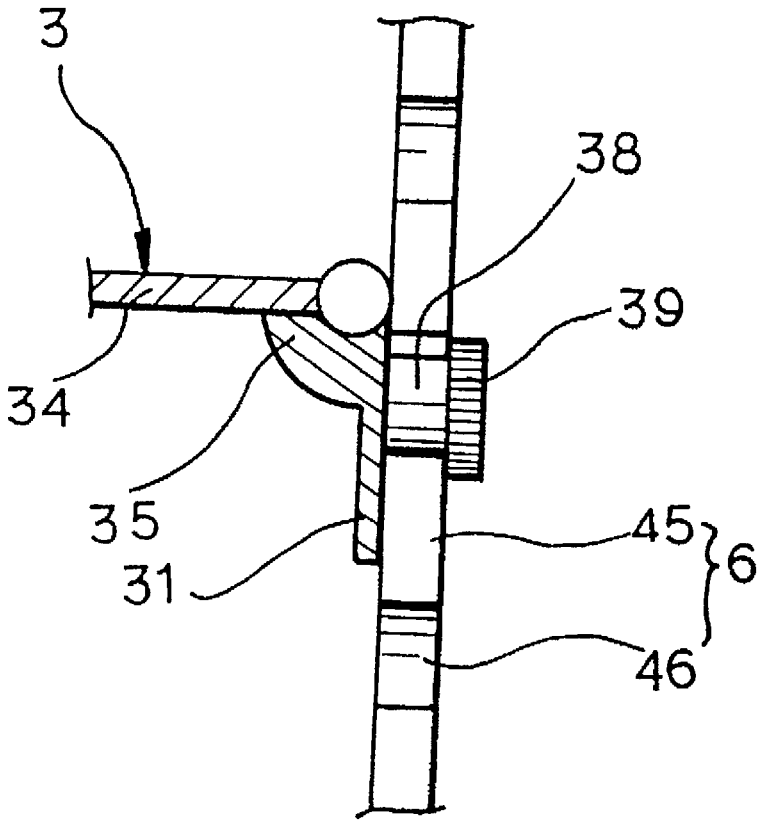
FIG. 6 is a section view taken along the line A—A in FIG. 5.

As shown in FIG. 6, the height adjustment device 6 includes two knobs 38 secured to the propping plate 31, each of which passes through the respective guide slots 45 and has a head part 39 for preventing movement of propping plate 31.

Accordingly, the supporting member 3 moves upwardly or downwardly along the guide slots 45 and the supporting member 3 can be fixed at an arbitrary height by pushing the knobs 38 to the corresponding notch.

Also each notch has a safety fixing part 47, which is dented downwardly, for preventing the knob 38 from being taken off easily.

Figure 7:
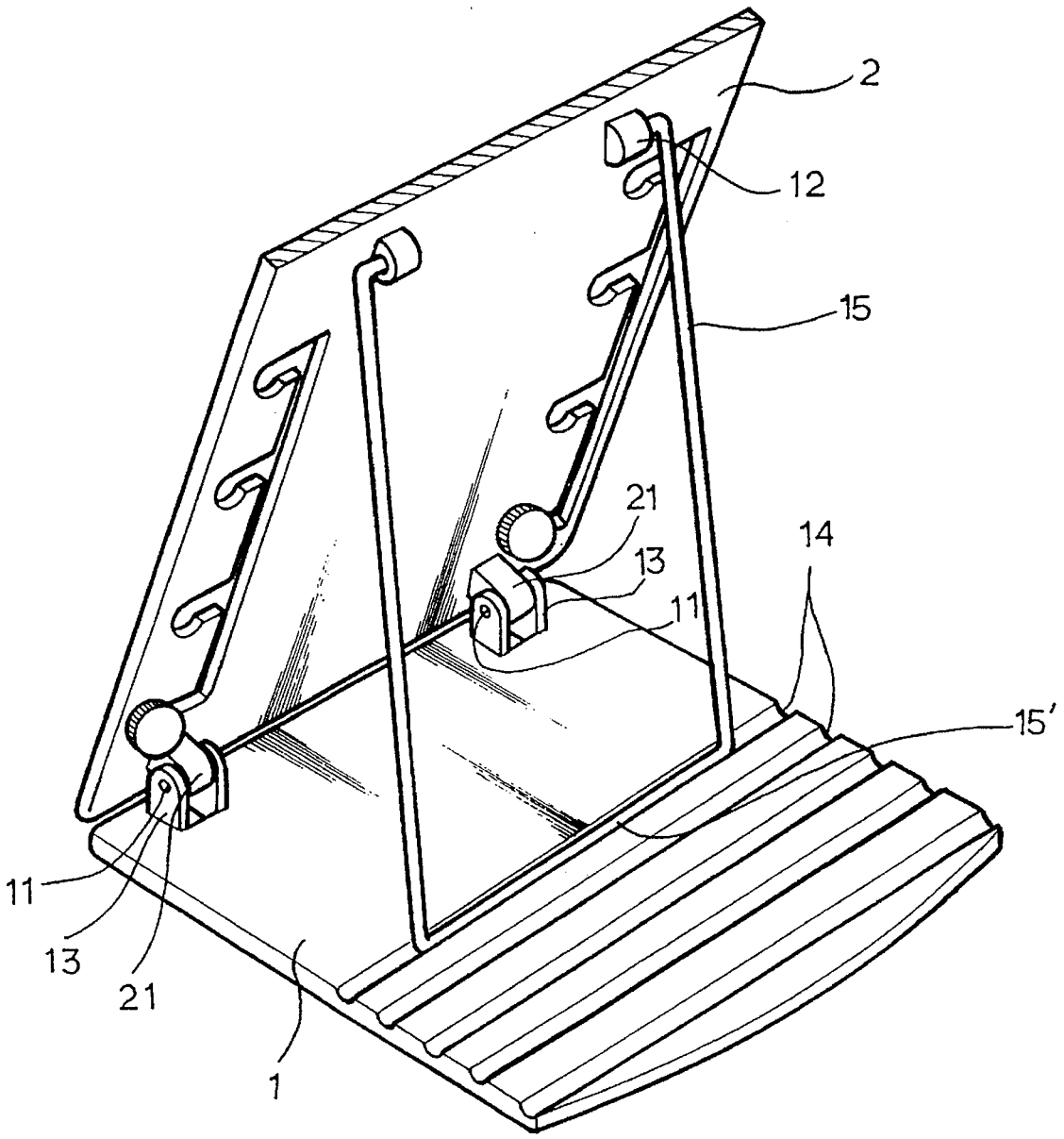
FIG. 7 is a perspective view for an angle adjustment device related to the second embodiment of the invention.

FIG. 7 shows an angle adjustment device related to the second embodiment of the invention and the angle adjustment device includes a support 15 connected to a fifth hinge part 12 provided in the rear surface of the plate 2 rotatably and multiple recesses 14 formed on the base member 1 similar to the first embodiment of the invention.

The present invention enables the reader or user to read in the most desirable position, i.e., at a comfortable height and angle made possible by the height adjustment device and the angle adjustment device.

Figure 8:
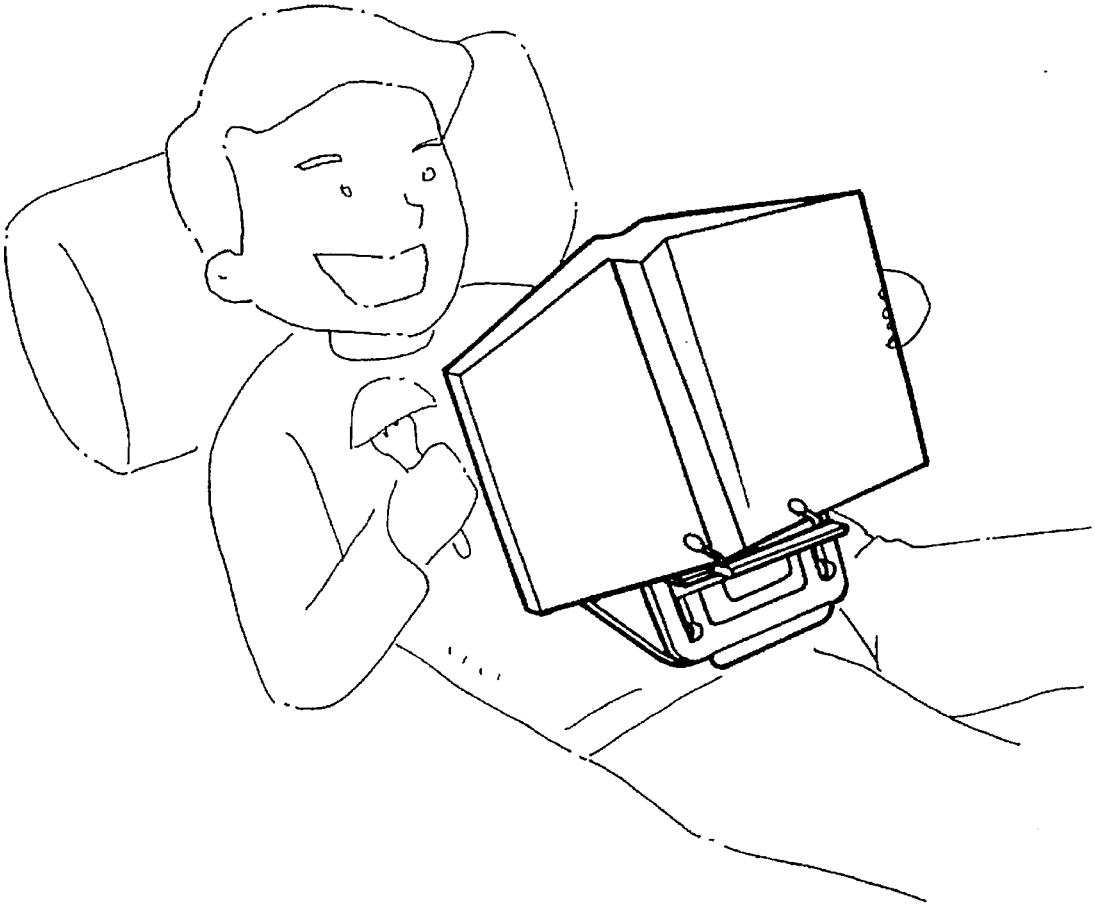
FIG. 8 is a view showing how to use the reading stand while lying down.

Moreover, by putting the face of the reading material toward the plate, which is plate formed of transparent material as in the first embodiment of the invention or the transparent plate connected to the plate as in the second embodiment of the invention, the reader or user can read through the plate while lying down as shown in FIG. 8.

Of course, the reader can use the reading stand related to the invention in a seated position, too.

And it is possible to form the shape of the base member to have a curvature, thereby the reader reads by placing the reading stand either on the chest or the knee of reader.

What is claimed is:

1. A reading stand comprising:

a base member;

a plate rotatably connected to the base member for supporting reading material;

a transparent plate rotatably connected with the plate on an upper edge of the plate, which can be arranged to be in the same plane as the plate and folded toward the plate;

a supporting member which supports a lower edge of the reading material placed on an upper surface of the plate;

an angle adjusting device for adjusting an inclination angle of the plate with respect to the base member; and a height adjusting device which adjusts a height of the supporting member, thereby adjusting a height of the reading material relative to the base member.

2. The reading stand according to claim 1 further comprising a rectangular-shaped concave part in the upper surface of the plate and a frame fitted into the rectangular-shaped concave part.

3. The reading stand according to claim 1, wherein the height adjusting device comprises two knobs, each having a head part, secured to the supporting member; two guide slots, each of which is formed on the plate longitudinally corresponding to the knobs and which the knobs pass through; and a plurality of notches formed in the guide slots and perpendicular to the guide slots.

4. The reading stand according to claim 3, wherein each one of the plurality of notches comprises a safety fixing part.

5. The reading stand according to claim 1, wherein the base member is formed to have a curvature.

* * * * *